US009399164B2

(12) United States Patent
Maier

(10) Patent No.: US 9,399,164 B2
(45) Date of Patent: Jul. 26, 2016

(54) CYCLING SUIT WITH A SEAT PAD

(71) Applicant: ASSOS OF SWITZERLAND S.A., San Pietro di Stabio (CH)

(72) Inventor: Roger Maier, Carona (CH)

(73) Assignee: Assos of Switzerland GmbH, San Pietro di Stabio (CH)

( * ) Notice: Subject to any disclaimer, the term of this patent is extended or adjusted under 35 U.S.C. 154(b) by 0 days.

(21) Appl. No.: 14/295,389

(22) Filed: Jun. 4, 2014

(65) Prior Publication Data

US 2014/0359926 A1 Dec. 11, 2014

(30) Foreign Application Priority Data

Jun. 5, 2013 (EP) ..... 13170695

(51) Int. Cl.
*A63B 71/12* (2006.01)
*A41D 1/08* (2006.01)
*A41D 13/05* (2006.01)

(52) U.S. Cl.
CPC ..... *A63B 71/1216* (2013.01); *A41D 1/084* (2013.01); *A41D 13/0525* (2013.01)

(58) Field of Classification Search
CPC . A41D 1/084; A41D 2600/104; A41D 1/082; A41D 1/088; A63B 71/1216
See application file for complete search history.

(56) References Cited

U.S. PATENT DOCUMENTS

| | | | | |
|---|---|---|---|---|
| 6,928,665 | B1 * | 8/2005 | Yates | 2/466 |
| 7,739,754 | B2 * | 6/2010 | Garneau | 2/466 |
| 8,042,197 | B2 * | 10/2011 | Maier | 2/228 |
| 8,087,097 | B2 * | 1/2012 | Maier | 2/227 |
| 8,272,073 | B2 * | 9/2012 | Arensdorf et al. | 2/267 |
| 2002/0029409 | A1 * | 3/2002 | Coccia | A41D 1/084 2/456 |
| 2003/0000004 | A1 * | 1/2003 | Maier | A41D 1/084 2/69 |
| 2007/0174953 | A1 | 8/2007 | Garneau | |
| 2012/0117704 | A1 * | 5/2012 | Hofeldt | 2/20 |

FOREIGN PATENT DOCUMENTS

| | | |
|---|---|---|
| DE | 202008004129 | 7/2008 |
| EP | 1972216 | 9/2008 |
| WO | 0219852 | 3/2002 |

* cited by examiner

*Primary Examiner* — Shaun R Hurley
*Assistant Examiner* — Andrew W Sutton
(74) *Attorney, Agent, or Firm* — Fox Rothschild LLP

(57) ABSTRACT

A cycling suit (1) comprising a seat pad (2) in the crotch area, said seat pad (2) comprising a soft fabric piece (3) and a padding (4), said fabric piece having a multi-layered structure comprising at least a first layer (5) in contact with the skin and an outer layer (7) opposite to said first layer, wherein said outer layer is perforated.

8 Claims, 2 Drawing Sheets

CYCLING SUIT WITH A SEAT PAD

CROSS REFERENCE TO RELATED APPLICATIONS

This US Application claims priority to European Application No.: 13170695.4, filed Jun. 5, 2013, entitled "A CYCLING SUIT WITH A SEAT PAD" the entirety of which is incorporated herein by reference.

FIELD OF THE INVENTION

The invention relates to the field of cycling sport suits. The invention relates in particular to a cycling suit including a seat pad in the crotch area, and to a seat pad for the making of a cycling suit.

PRIOR ART

It is a known technique to provide cycling suits with a seat pad for a better protection and comfort of body parts in contact with the saddle of the bicycle.

The seat pad may comprise a soft fabric piece, which is also termed cover, and a padding. The padding is normally in the form of two or more shaped pads fixed to said cover or, less frequently, to the cycling suit. The cover is fixed to the suit, for example by sewing, gluing or welding or another technique. The cover may have a multi-layered structure, for example including a layer of a soft expanded material sandwiched between two fabric layers. The layer in contact with the skin is commonly referred to as the first layer.

Cycling suits including a seat pad are disclosed e.g. in EP-A-1972216 and EP-A-2494878.

CH 702 218 discloses a breathable composite cloth for the bottom of sports clothing comprises a perforated layer of soft expanded material covered with two breathable layers.

SUMMARY OF THE INVENTION

The aim of the invention is to still improve the comfort of the seat pad of cycling suits, with a view to improve the performance under intensive use. The invention in particular is directed to an improvement of the multi-layered cover of the seat pad.

These aims are reached with a cycling suit comprising a seat pad located in a crotch area of the suit, where:

the seat pad comprises a cover made of a shaped soft fabric piece fixed to the cycling suit, said cover has a multi-layered structure comprising at least a first layer, facing the inside of the suit so that it is contact with the skin when the suit is worn, and an outer layer opposite to said first layer, characterized in that: said outer layer is perforated.

Preferably, said cover comprises one or more intermediate layer(s) between said first layer and outer layer.

The seat pad may comprise a padding. Said padding can be fixed (e.g. sewn) to the cover or to the cycling suit.

In a preferred embodiment, said cover has a three-layered structure including a third layer which is sandwiched between the first layer and the outer layer. More preferably, said third layer is made of a soft expanded material. Preferably said intermediate layer is made of a synthetic foam rubber, such as Moltoprene for example. More preferably, also the intermediate layer is perforated.

The first layer in contact with the skin is continuous, that is non-perforated.

The perforated outer layer comprises a dense pattern of holes, having a diameter which is preferably around 2 to 15 mm, more preferably 7-8 mm.

The advantages of the invention include less weight and improved breathability, thanks to the combination of a breathable first layer, an intermediate soft layer and a perforated outer layer. This is in contrast with established practice where the outer layer was always a continuous and non-perforated layer.

Another aspect of the invention is a seat pad for a cycling suit. Said seat pad comprises a shaped soft fabric piece, or cover, to be fixed to said cycling suit and may comprise a padding fixed to said cover. The cover has a multi-layered structure comprising at least a first layer for contact with the skin during the use, and an outer layer opposite to said first layer, and said outer layer is perforated.

It should be noted that the term of cycling suit in this description and in the attached claims encompasses various items including at least a trouser portion having a crotch area, such as a bodysuit, a pair of trousers and the like.

The following detailed description is given for indicative and not limiting purpose.

DETAILED DESCRIPTION

Figure 1:
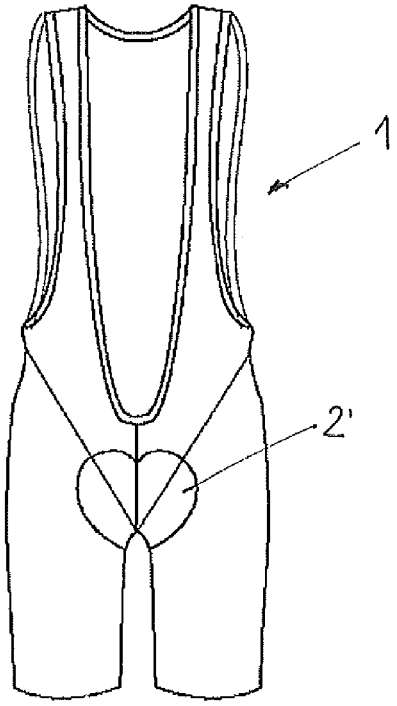
FIG. 1 is a view of a cycling suit according to an embodiment of the invention.

FIG. 1 shows a cycling suit 1 including a seat pad 2 in the crotch area. The cycling suit 1 is made of a suitable elastic fabric, such as Lycra, and may have different forms, such as a bodysuit, a pair of trousers, and others, according to various embodiments of the invention and the intended use, e.g. winter or summer, male or female, etc.

Figure 2:
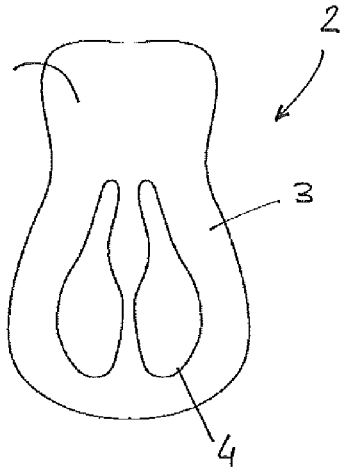
FIG. 2 is a top view of the seat pad of the cycling suit of FIG. 1.
Figure 3:
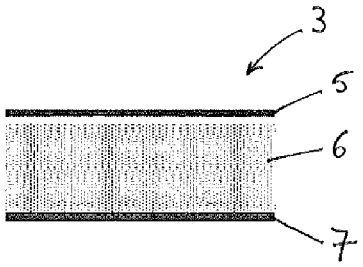
FIG. 3 is a cross section of the seat pad of FIG. 2, showing the multi-layered structure of the cover.

The seat pad 2 is better illustrated in FIGS. 2 and 3. Said seat pad 2 includes a soft fabric piece to form a cover 3. Said cover 3 is fixed (e.g. stitched) to the inside of the crotch area of the cycling suit 1. The seat pad 2 also comprises a suitable padding which for example includes a couple of pads 4.

FIG. 2 shows a typical shape of a seat pad; said pad 2 may have a concave shell in the front and/or rear portion. In some embodiments, the seat pad 2 may be fixed to the suit 1 along a front attachment region and a rear attachment region, leaving a loose central portion for a better comfort, according to EP 2494878.

The cover 3 has a multi-layered structure, which in this example included three layers: a first layer 5, an intermediate soft layer 6, and an outer layer 7. The structure is depicted in FIG. 3, note that the thickness of the layers is not in scale.

The first layer 5, during the use, is normally in contact with the skin. The outer layer 7 is opposite to the first layer 5 and faces the suit 1.

Figure 4:
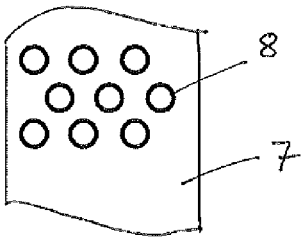
FIG. 4 shows an embodiment of one of the layers forming the cover of the seat pad of FIG. 2.
Figure 5:
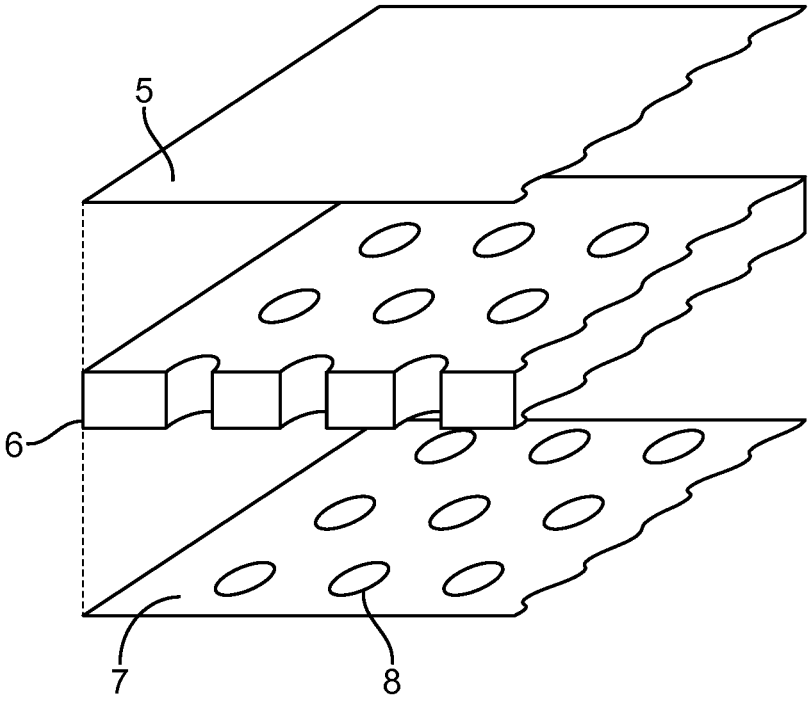
FIG. 5 shows one embodiment of the structure of the cover.

FIG. 4 shows a piece of fabric that can be used as the outer layer 7. Said outer layer 7 is perforated as shown in the figure, including a plurality of holes 8 according to a suitable dense pattern and having a diameter for example around 7-8 mm.

The cycling suit 1 is made preferably with an elastic woven or knitted fabric and the seat pad 2 is preferably made with a soft material and more preferably with a soft material which is elastic in all directions.

In a more preferred embodiment: the first layer and the outer layer are made in part of an elastomer (for example Polyammide PA and elastomer) and the intermediate layer is made of a synthetic foam rubber.

The invention meets the aforesaid scopes, providing less weight and improved breathability of the seat pad, compared to the prior art.

The invention claimed is:

1. A cycling suit comprising a seat pad located in a crotch area of the suit, where:

said seat pad comprises a cover made of a shaped soft fabric piece fixed to the cycling suit and said cover comprises: a first layer, facing the inside of the suit so that it is in contact with the skin when the suit is worn; an outer layer opposite to said first layer, a third layer which is sandwiched between the first layer and the outer layer, said third layer being made of a soft expanded material, said outer layer and said third layer being perforated, and wherein said first layer of the seat pad is non-perforated.

2. The cycling suit according to claim 1, wherein the perforated outer layer of the seat pad comprises holes having a diameter 2 mm to 15 mm.

3. The cycling suit according to claim 1, wherein the seat pad further comprises padding fixed to the cover.

4. The cycling suit according to claim 1, wherein the first layer and the outer layer comprise an elastomer and the third layer comprises a synthetic foam rubber.

5. A seat pad for a cycling suit, where:

said seat pad comprises a cover made of a shaped soft fabric piece, to be fixed to said cycling suit and said cover comprises: a first layer, to face the inside of the suit so that it is in contact with the skin during use; an outer layer opposite to said first layer, a third layer which is sandwiched between the first layer and the outer layer, said third layer being made of a soft expanded material, said outer layer and said third layer being perforated, and wherein said first layer is non-perforated.

6. The seat pad according to claim 5, wherein the perforated outer layer of the seat pad comprises holes having a diameter 2 mm to 15 mm.

7. The seat pad according to claim 5, wherein the seat pad further comprises padding fixed to the cover.

8. The seat pad according to claim 5, wherein the first layer and the outer layer comprise an elastomer and the third layer comprises a synthetic foam rubber.

* * * * *